US012471632B2

(12) United States Patent
Hupkes et al.

(10) Patent No.: US 12,471,632 B2
(45) Date of Patent: Nov. 18, 2025

(54) HEATER ARRANGEMENT

(71) Applicant: JT International SA, Geneva (CH)

(72) Inventors: Ernst Hupkes, Kampen (NL); Bijlsma Menno, Zwolle (NL)

(73) Assignee: JT International SA (CH)

( * ) Notice: Subject to any disclaimer, the term of this patent is extended or adjusted under 35 U.S.C. 154(b) by 475 days.

(21) Appl. No.: 17/802,402

(22) PCT Filed: Feb. 26, 2021

(86) PCT No.: PCT/EP2021/054895
§ 371 (c)(1),
(2) Date: Aug. 25, 2022

(87) PCT Pub. No.: WO2021/170833
PCT Pub. Date: Sep. 2, 2021

(65) Prior Publication Data

US 2023/0165309 A1 Jun. 1, 2023

(30) Foreign Application Priority Data

Feb. 28, 2020 (EP) ..... 20160261

(51) Int. Cl.
*A24F 40/46* (2020.01)
*A24F 40/70* (2020.01)

(52) U.S. Cl.
CPC ..... *A24F 40/46* (2020.01); *A24F 40/70* (2020.01)

(58) Field of Classification Search
None
See application file for complete search history.

(56) References Cited

U.S. PATENT DOCUMENTS

2014/0202475 A1* 7/2014 Liu ..... A24F 40/40 131/329
2016/0302485 A1 10/2016 Alima
(Continued)

FOREIGN PATENT DOCUMENTS

CN 103720056 A 4/2014
CN 107183789 A 9/2017
(Continued)

OTHER PUBLICATIONS

International Search Report for Application No. PCT/EP2021/054895 mailed May 26, 2021, pp. 1-3.
(Continued)

*Primary Examiner* — Philip Y Louie
*Assistant Examiner* — Jeffrey A. Buckman
(74) *Attorney, Agent, or Firm* — Lerner David LLP

(57) ABSTRACT

A heater arrangement for an aerosol generating device includes a tubular heating chamber including a cavity arranged to receive an aerosol generating substrate, a layer of insulation wrapped so as to circumferentially surround the heating chamber and an insulation support assembly including a rigid surround arranged around the heating chamber; wherein the insulation support assembly is arranged to engage the heating chamber and the insulation layer to hold the insulation layer in position around the heating chamber. Devices utilising such a heating arrangement display improved thermal insulation performance and allow for greater freedom in selecting insulating materials. The heater arrangement is also lower cost compared to conventional insulated heaters, for example those utilising vacuum tubes, as well as being lower weight. The insulation support assembly reduces heat transfer from the heater and also improves ease of assembly.

30 Claims, 10 Drawing Sheets

(56) References Cited

U.S. PATENT DOCUMENTS

| | | | | |
|---|---|---|---|---|
| 2017/0013885 | A1 | 1/2017 | Qiu | |
| 2019/0037925 | A1* | 2/2019 | Hon | A61M 15/0001 |
| 2019/0208816 | A1* | 7/2019 | Thorsen | A24F 40/485 |
| 2020/0154766 | A1 | 5/2020 | Jeong | |
| 2022/0167675 | A1* | 6/2022 | Thorsen | H05B 6/108 |
| 2022/0386698 | A1* | 12/2022 | Batista | H05B 6/44 |

FOREIGN PATENT DOCUMENTS

| | | | |
|---|---|---|---|
| CN | 207220165 | U | 4/2018 |
| CN | 208080537 | U | 11/2018 |
| CN | 208875414 | U | 5/2019 |
| CN | 110089777 | A | 8/2019 |
| CN | 110313635 | A | 10/2019 |
| KR | 20190010216 | A | 1/2019 |
| WO | 2019126997 | A1 | 7/2019 |
| WO | 2021023842 | A1 | 2/2021 |

OTHER PUBLICATIONS

Search Report dated Mar. 14, 2024 from Office Action for Tawainese Application No. 110107123 issued Mar. 18, 2024. 2 pgs.
Search Report dated Jan. 26, 2025 from Office Action for Chinese Application No. 202180017173.2 issued Feb. 7, 2025.4 pgs.

* cited by examiner

HEATER ARRANGEMENT

CROSS-REFERENCE TO RELATED APPLICATIONS

The present application is a national phase entry under 35 U.S.C. § 371 of International Application No. PCT/EP2021/054895, filed Feb. 26, 2021, published in English, which claims priority to European Application No. 20160261.2 filed Feb. 28, 2020, the disclosures of which are incorporated herein by reference.

FIELD

The present disclosure relates to a heater arrangement, in particular a heater arrangement for an aerosol generation device. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat aerosolisable substances to release a vapour for inhalation, rather than relying on burning of tobacco.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 300° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aersolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

Known aerosol generating devices typically include a heating chamber for receiving a consumable aerosol generating substrate, a power source and control circuitry for controlling the supply of power to the heating chamber from the power source. One known issues with such devices is that the inevitable proximity of the heating chamber to the power source and control circuitry within the device can cause unwanted heating of the power source and electronic circuitry. This heating may damage these heat-sensitive electronic components and, in some cases, this may even be dangerous with a risk of fire or explosion when components that are not designed to be heated become too hot.

It is an object of the present invention to address the above mentioned issues and provide an aerosol generating device in which heat management is improved whilst still providing a compact, user-friendly device.

SUMMARY

In a first aspect of the invention there is provided a heater arrangement for an aerosol generating device, the heater arrangement comprising: a tubular heating chamber comprising a cavity arranged to receive an aerosol generating substrate; a layer of insulation wrapped so as to circumferentially surround the heating chamber; an insulation support assembly comprising a rigid surround arranged around the heating chamber; wherein the insulation support assembly is arranged to engage the heating chamber and the insulation layer to hold the insulation layer in position around the heating chamber. Devices utilising such a heating arrangement display improved thermal insulation performance and allow for greater freedom in selecting insulating materials. The heater arrangement according to the present invention is also lower cost compared to conventional insulated heaters, for example those utilising vacuum tubes, as well as being lower weight. The insulation support assembly reduces heat transfer from the heater and also improves ease of assembly.

Preferably the insulation support assembly comprises a non-metal. Preferably the insulation support assembly is made of a non-metal. Preferably the non-metal is a heat resistant polymer, most preferably Polyetheretherketone (PEEK). Such materials reduce thermal transfer to components surrounding the heater arrangement and are also lightweight, improving the usability and ease of assembly.

Preferably the layer of insulation comprises a sheet of thermally insulating material. Preferably the layer of insulation is wrapped one or more times around the tubular heating chamber. Preferably the layer of insulation comprises one or more of: ceramic fibre, for example Superwool™, one or more metal oxides, and an aerogel. In some examples of the invention, the layer of insulation comprises a ceramic fibre sheet comprising aluminium oxide, silicon oxide and/or ZrO2, Preferably the insulation layer is formed as a blanket, felt or paper. In particular the insulation layer may comprise a layer which is wrapped around the heating chamber. The insulation layer may comprise a flexible, flat piece of insulating material suitable for being wound around the heating chamber, within or outside of the rigid surround.

Preferably the rigid surround extends around the circumference of the tubular heating chamber and extends over the majority, preferably the entirety, of the length of the heating chamber. In this way the rigid surround may support the layer of insulation over the circumference and length, i.e. the cylindrical surface area, of the tubular heating chamber.

Preferably the insulation support assembly is arranged to contact the heating chamber only at one or both ends of the heating chamber to support the rigid surround in position around the heating chamber. Since the longitudinal ends of the heating chamber are the lowest temperature points on the heating chamber, by connecting the support assembly to one or both ends points, heat transfer to the insulation support assembly is minimised. Other than the connection points at one or both ends of the heating chamber, the remainder of the insulation support is preferably supported so as to leave a gap between the insulation support and the surface of the heating chamber.

Preferably the insulation support assembly comprises one or more annular supports wherein the annular supports are mounted around an end of the heating chamber and support the rigid surround in position around the heating chamber. The annular supports preferably extend partially or wholly around the circumference of the heating chamber. In this way, the annular supports may provide a secure mechanical connection to support the rigid surround. One or more annular supports may comprise an annular body extending around a majority of the circumference of an end of the heating chamber and a plurality of longitudinal struts, arranged periodically around the annular body, which extend along the length of the heating chamber. In this way the length tolerance of the insulation support assembly and heater chamber is greater, aiding the manufacturing process. Preferably the annular support and rigid surround are configured to connect, via a mechanical connection, such that the annular supports support the rigid surround. The one or more annular supports may also be configured to engage with a frame within an aerosol generating device such that they allow for the heater assembly to be mounted in position within an aerosol generating device.

Preferably the layer of insulation is wrapped around an outer surface of the rigid surround. In other words, an outer surface of the rigid surround holds the insulation layer in position around heating chamber. The rigid surround may comprise a frame connected to the ends of the heating chamber on which the layer of insulation is supported.

In these examples of the invention, the rigid surround preferably comprises a frame comprising a plurality of longitudinal struts running along the length of the tubular heating chamber; wherein the insulation layer is wrapped around an outer surface formed by the longitudinal struts. The frame may comprise two end rings, each positioned around a longitudinal end of the heating chamber wherein the longitudinal struts run between the ends rings, along the length of the heating chamber. In this way, a minimal amount of material is used for the rigid surround, which acts to support the insulation layer in position. Furthermore the number of parts required for the insulation support assembly is reduced.

Preferably the rigid surround comprises a gripping member arranged to grip the layer of insulation and hold at least a portion of it in position. In some examples the gripping member extends radially outward from the rigid surround to engage the layer of insulation. For example the gripping member may comprise a barb or sharp point arranged to pierce the layer of insulation. In other examples the gripping member may be placed over the wrapped insulation to hold it in place, for example the gripping member may comprise a clamp.

In other examples of the invention, the layer of insulation is wrapped around the tubular heating chamber and is positioned within the rigid surround. In this way the rigid surround supports the outer surface of the insulating layer to hold it in position.

Preferably, the rigid surround comprises a tubular casing arranged to enclose the tubular heating chamber to form a cylindrical cavity between the outer surface of the heating chamber and the inner surface of the casing, wherein the layer of insulation is held within the cavity. In this way, the surround encloses the layer of insulation in position and provides a rigid outer structure to allow mounting of the heater assembly within an aerosol generating device. The tubular casing also preferably comprises a heat insulating material to further enhance the heat management properties. Preferably the cavity of the casing is dimensioned such that the insulation layer contacts both the surface of the heating chamber and the internal surface of the casing at least at one circumferential region.

Preferably the cylindrical cavity has a radial thickness between 2 mm and 4 mm, more preferably between 2.4 and 3.5 mm, most preferably about 3.0 mm. The layer of insulation is preferably wrapped such that it occupies the full radial thickness of the cavity.

Preferably the heater arrangement further comprises an annular support positioned at one end of the tubular heating chamber between the tubular heating chamber and casing, the annular support extending around a majority of the circumference of the tubular heating chamber. In this way the annular support acts to separate the tubular casing from the heating chamber and only contacts the heating chamber at the coolest point to minimise heat transfer to the insulation support assembly. The annular support may be entirely covered by the casing or may extend out of the case, for example to enable connection to a frame within an aerosol generating device.

Preferably the annular support comprises a plurality of axial struts, for example three axial struts, extending along the axis of the tubular heating chamber and arranged to hold the heating chamber within the casing. The axial struts act to grip the heating chamber to support it in the correct position within the casing, whilst minimising contact with the heating chamber.

In some examples the tubular heating chamber may comprise a circumferential flange (referred to herein as a lip). The insulation support assembly may comprise a connection feature configured to receive the circumferential lip to support the heating chamber. In particular the connection features may be arranged to receive and grip the lip to hold the heating chamber in position, for example the connection feature may comprise a groove or recess arranged to engage with the lip In particular, the tubular casing and the annular support may be configured to lock together around the lip to secure the heating chamber within the tubular casing. This provides a secure arrangement to hold the heating chamber in position, while only gripping the lip around the opening to the heating chamber, thereby minimising heat transfer from the heating chamber to the support assembly.

The tubular casing may comprise two semi-cylindrical parts, the parts configured to connect along a longitudinal interface to form the tubular casing around the heating chamber. This facilitates assembly, allowing the layer of insulation to be wound on the heating chamber and the tubular casing connected around the heating chamber and layer of insulation.

The heater arrangement may further comprise a gripping member attached to the outer surface of the heating chamber arranged to grip the layer of insulation and hold at least a portion of the layer of insulation in position. Preferably the gripping member comprises a barbed clamp arranged to attach to the outer surface of heating chamber below the layer of insulation, the barbed clamp comprising an outward facing barb configured to grip the layer of insulation.

The tubular casing may comprise a base surface, at least partially enclosing the tubular casing around the base (closed) end of the tubular heating chamber. The tubular casing may be arranged to provide a gap between base surface of the casing and the base surface (the closed end) of the heating chamber. Insulation may be provided within the gap, for example insulating material may be positioned in the gap, between the closed end of the heating chamber and the based end of the tubular casing. The base surface of the tubular casing may further comprise an opening to allow electrical connections to the heating chamber (i.e. to a heater arranged to heat the heating chamber) to pass through. The base surface is preferable configured such that the opening is directed at an angle relative to the longitudinal axis of the heating chamber. In this way, heat is not directed directly out of the casing along the tubular axis but may be directed away from sensitive electronic components such as a battery.

In some embodiments, where the tubular heating chamber comprises an open end arranged to receive the aerosol generating substrate and an opposing closed end; the tubular casing may comprise an at least partially closed end, the at least partially closed end comprising a protrusion extending from an inner surface to engage the closed end of the heating chamber. The closed end of the tubular heating chamber may comprise a recess in the outer surface of the closed end and the protrusion may be configured to engage with the recess, thereby providing extra stability while minimising heat transfer between the heating chamber and the support assembly.

In some embodiments where the tubular heating chamber comprises an open end arranged to receive the aerosol generating substrate and an opposing closed end, the heater arrangement may further comprise: an end cap support, the end cap support welded to the outer surface of the closed end of the heating chamber and arranged to support the tubular casing in position around the heating chamber. By welding, preferably spot welding, the end cap support to the base of the heating chamber, the heating chamber is supported at the coldest point on the heating chamber, furthermore, the weld points provide a thermal barrier, reducing heat transfer to the end cap support. Further insulating material may be provided between the end cap support and heating chamber, around the welded parts, to further enhance the insulating effect. The end cap support preferably comprises a protrusion which extends from a disk shaped body, where the protrusion is welded to the closed end of the heating chamber. The heating chamber may comprises a recess on the outer surface of the closed end and the protrusion may be welded within the recess, providing extra support. This arrangement requires a reduced number of components.

The end cap support may comprise an opening to allow for electrical connection to pass through. The end cap support is preferably a metal end cap.

The layer of insulation may be maintained in place by a piece of tape before encasing by the casing to avoid it unrolling before encasing.

Preferably the tubular casing and one or more annular supports are made of PEEK.

The tubular casing may be internally coated with a metal heat reflective layer or a metal foil can be wound together with the insulation layer.

The tubular casing may be externally covered by an adhesive support layer such as graphite with adhesive layer.

The tubular casing may be assembled by mechanical connection and/or guiding elements such as one or more of pins/holes, press-ftting, ultrasonic welding, inorganic adhesive, screws, and magnets.

In a further aspect of the invention there is provided an aerosol generating device comprising a heater arrangement as defined in the appended claims. The aerosol generating device preferably comprises an internal support frame and the insulation support assembly is configured to engage with the internal support frame such that the heater assembly is held in positioned within the aerosol generating device.

DETAILED DESCRIPTION

Figure 1A:
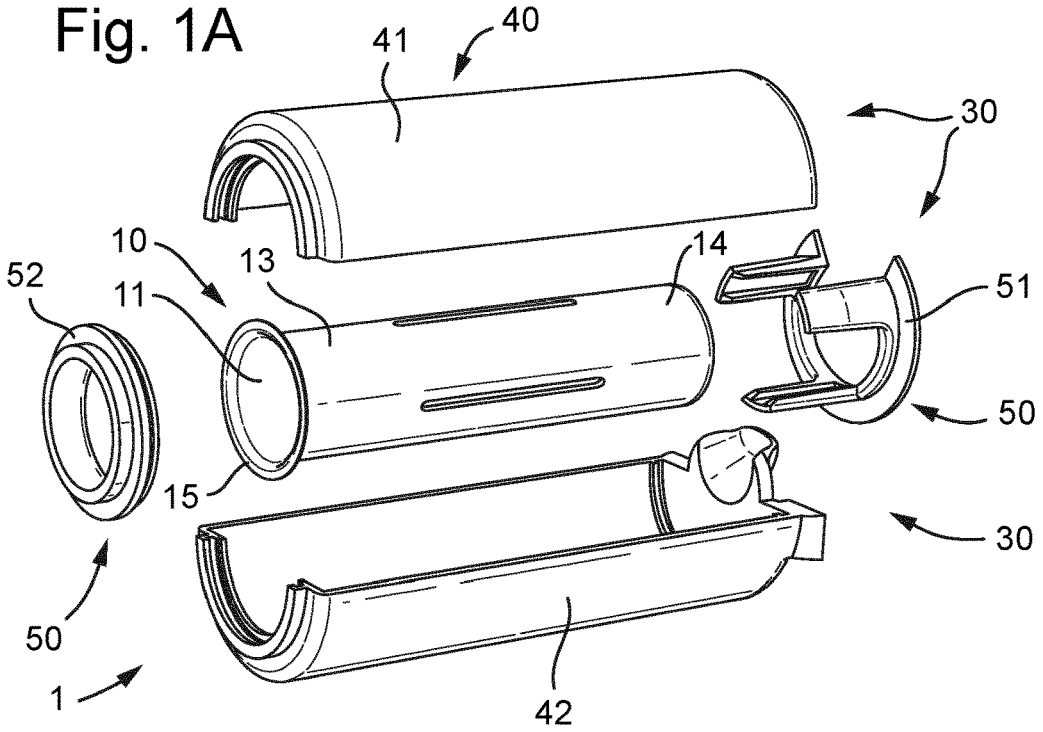
FIGS. 1A and 1B are schematic views of a heater arrangement for an aerosol generating device.
Figure 1B:
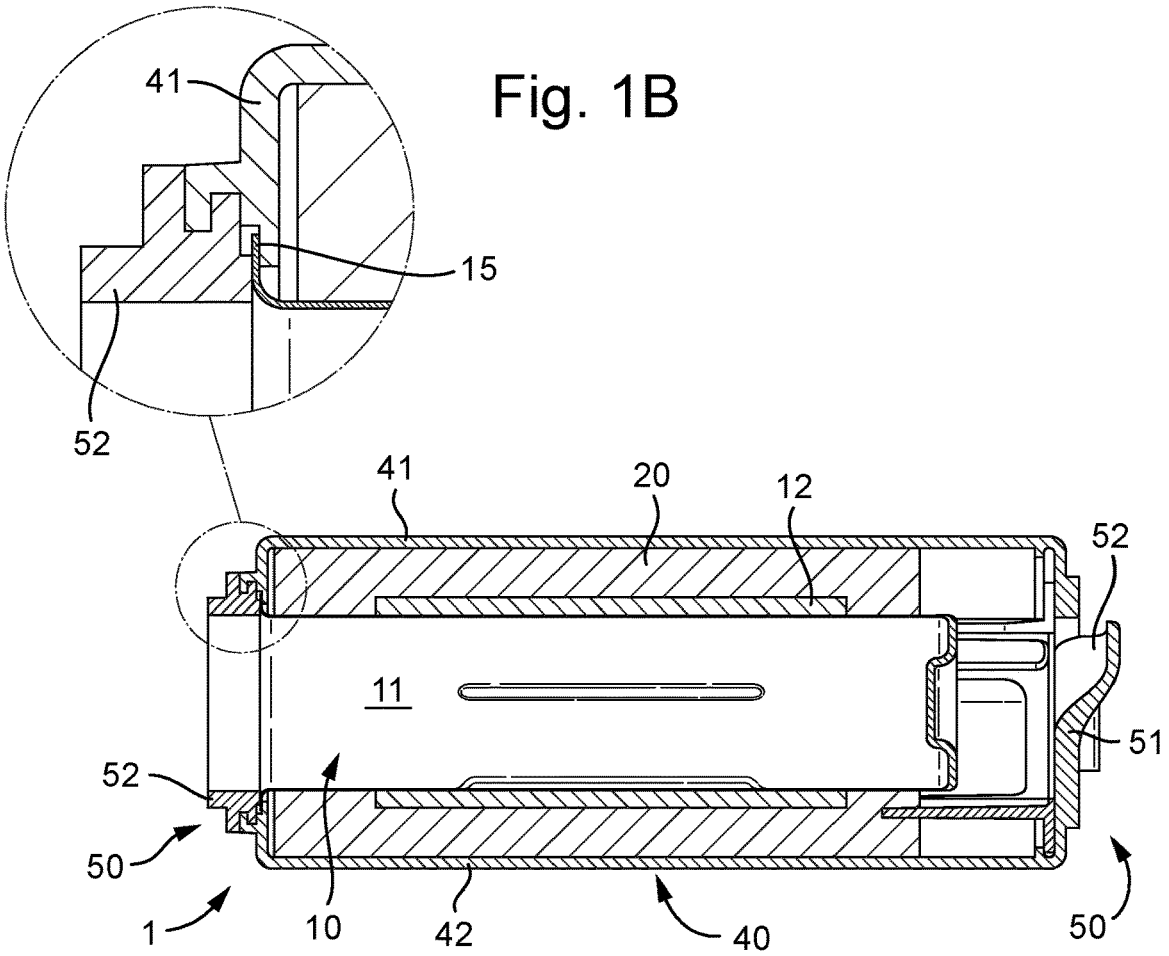

FIGS. 1A and 1B schematically illustrate a heater arrangement 1 for an aerosol generating device 100 such as that pictured in FIG. 2. The heater arrangement 1 includes a tubular heating chamber 10 comprising a cavity 11 arranged to receive an aerosol generating substrate. The tubular heating chamber 10 is wrapped with a layer of insulation 20, shown in the cross section view of FIG. 1B, so as to circumferentially surround the heating chamber 10. The heater arrangement 1 further includes an insulation support assembly 30 including a rigid surround 40 arranged around the heating chamber 10. The insulation support assembly 30 is arranged to engage the heating chamber 10 and the insulation layer 20 so as to hold the insulation layer 20 in position around the heating chamber 10.

Unlike known devices which commonly use vacuum tubes as insulators for the heater chamber 10, the heater arrangement 1 according to the present invention allows for a greater selection of thermally insulating materials allowing improved thermal insulation performance. The heater arrangement 1 is also lower cost compared to vacuum tubes, easier to assemble and is low weight further increasing the ease of assembly and support within the device, while providing a lighter and more user friendly device to the user.

As shown in FIG. 1A the insulation support assembly is a multicomponent assembly comprising a rigid surround 40 which in the example of FIG. 1 takes the form of a two part tubular housing comprising two semi-cylindrical housing portions 41, 42 which connect around the heating chamber 10 along a longitudinal interface to form a rigid cylindrical surround which holds the insulating layer 20, shown in FIG. 1B, in position around the heating chamber 10. In the example of FIG. 1, the heating chamber 10 is heated by a thin film heater 12 which is wrapped circumferentially around an outer surface of the heating chamber 10, as shown in cross section in FIG. 1B. The layer of insulation 20 surrounds the heating chamber 10 and thin film heater 12 to restrict the passage of heat out of the rigid surround 40 to the other external components of the device.

In the example of FIGS. 1A and 1B the insulation support assembly 40 also includes heating chamber supports 50. The heating chamber supports 50 in this case take the form of annular or partially annular supports which engage with the ends 13, 14 of the tubular heating chamber 10 and also engage with the rigid surround 40, such that they hold the heating chamber 10 in position within the rigid surround 40. As explained further below, the heater chamber support 50 contacts only the longitudinal ends 13, 14 of the heating chamber 10 which are the coolest points on the heating chamber 10 so as to minimise the transport of heat from the heating chamber 10 to the rigid surround 40 and the connecting components of the aerosol generating device 100.

Figure 2A:
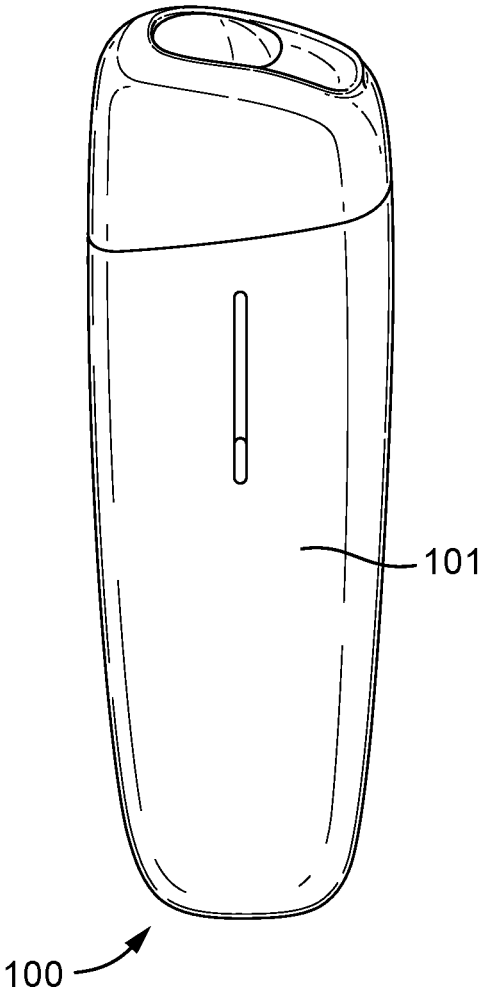
FIGS. 2A and 2B are schematic views of an aerosol generating device.
Figure 2B:
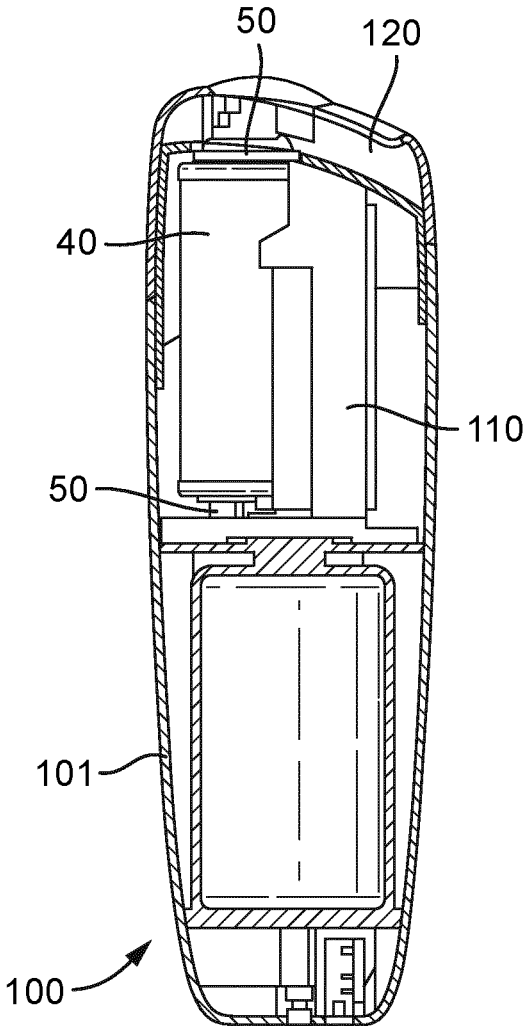

The assembled heater assembly 1 as shown in FIG. 1B may then be mounted within an aerosol generating device as shown in FIGS. 2A and 2B. In particular, the heater assembly 1 may be held within a housing 101 of the aerosol generating device 100 by a heater assembly frame 110. The heater chamber support 50 are configured to connect with connection features on the heater chamber frame 110 such that the heater assembly 1 is supported within the housing 101 of the device 100 by the engagement between the heater supports 50 of the insulation support assembly and the frame 110. In this way, the thermal connection points between the heating chamber 10 and the remaining internal components of the device 100 and the housing 101 are minimised. In particular, since the chamber supports 50 only contact the heating chamber 10 at the longitudinal ends, the coolest points, and further because the contacts between the heating chamber supports 40 and the frame 110 and surround 40 are minimised, the spread of heat to the remaining components of the device is significantly restricted.

The insulation support assembly including the rigid surround 40 and the heater chamber supports 50 preferably comprise a heat resistant polymer material, such as PEEK. The thermal insulation layer is preferably in the form of a sheet which is wound circumferentially around the heating chamber for at least one turn, preferably multiple turns, in order to further improve the thermal insulation. Different materials may be selected for the thermal insulation layer 20. The examples include aerogels or a ceramic fibre material i.e. a metal oxide fibre material. For example a ceramic fibre sheet comprising aluminium oxide, silicon oxide and/or ZrO2. One example of such a material is a Superwool™ blanket.

The rigid surround is configured to support the sheet of insulating material 20 in position around the heating chamber 10. In the example of FIG. 1, the tubular housing 40 forming the rigid surround preferably is sized to provide a cylindrical cavity with a radial thickness between 2 and 4 millimetres and preferably around 3 millimetres. The insulation support assembly 30 includes a base heating chamber support 51 which is shaped so as to provide an opening for connections from the heater 12 to pass to the control circuitry and battery. As shown in FIG. 1B, the base heating chamber support 51 is preferably shaped so as to provide a passage which directs the connections at an angle relative to the elongate axis of the heater assembly 1 to block a direct thermal route parallel with the elongate axis. This minimises the passage of heat directly from the heating chamber downwards towards the battery and other internal components of the device and instead directs heat out laterally in a direction approximately perpendicular to the elongate axis of the heater assembly 1 to further improve heat management.

This general principle of the invention therefore provides a lightweight assembly 40 surrounding the heating chamber 10 in order to securely hold the insulation layer 20 in position around the heater 12 and the heating chamber 10, whilst only maintaining minimal contact with the heating chamber, preferably just at the end points and therefore provides a cheap, lightweight and easy to assemble alternative to a vacuum tube for application in aerosol generating devices 1. Within this general concept, the heater arrangement 1 may be implemented in a number of different ways. Certain exemplary arrangements in which the invention may be implemented are illustrated in FIGS. 3, 4, 5 and 6 and will now be described in detail. The individual components of the following examples may be exchanged between the examples and the features of various embodiments can be combined within the above broad principle of the invention.

FIGS. 3A to 3F schematically illustrate an example of a heater arrangement 1, similar to that illustrated in FIGS. 1A and 1B in which the rigid surround takes the form of a two part cylindrical casing 41, 42. As described above, the tubular heating chamber 10 comprises an open end 13 through which a consumable aerosol generating substrate may be inserted into the internal cavity 11 and an opposing closed end 14 at the opposite longitudinal end of the chamber 10. The heating chamber 10 is wrapped with a thin film heater 12 comprising a resistive heating track on a flexible electrically insulating backing film, with connections 16 extending out from the base 14 end of the heating chamber 10 for connection to control circuitry and the power source.

Figure 3A:
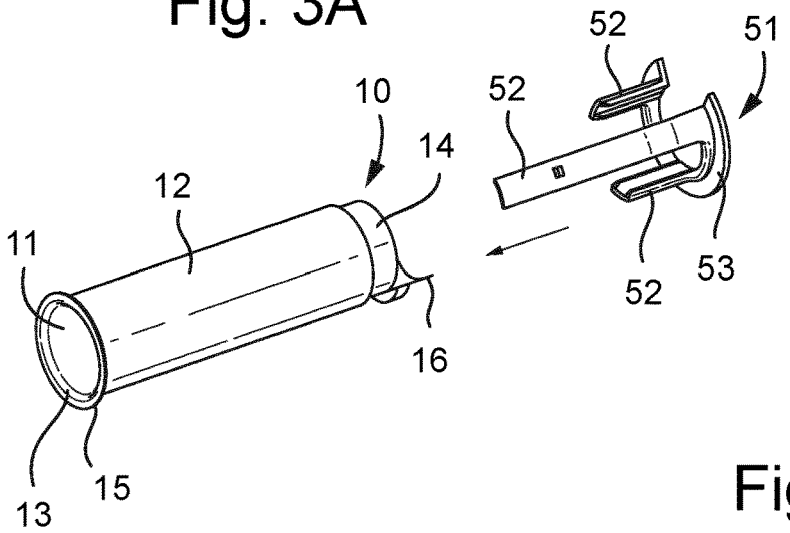
FIGS. 3A to 3F are schematic views of a heater arrangement for an aerosol generating device.
Figure 3B:
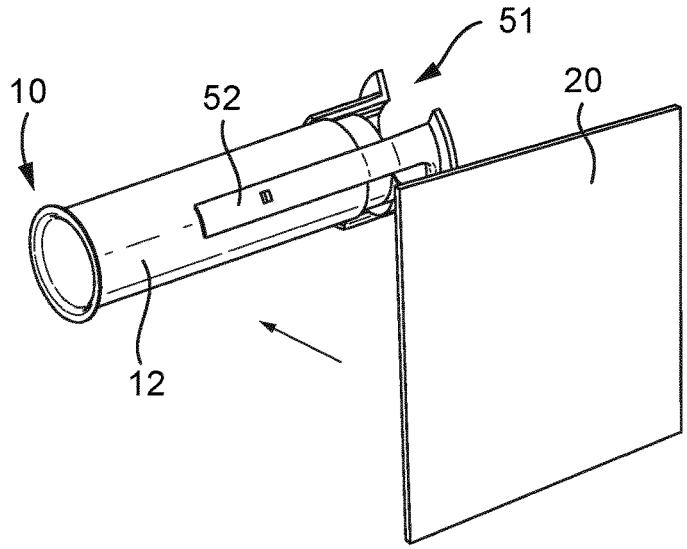
Figure 3C:
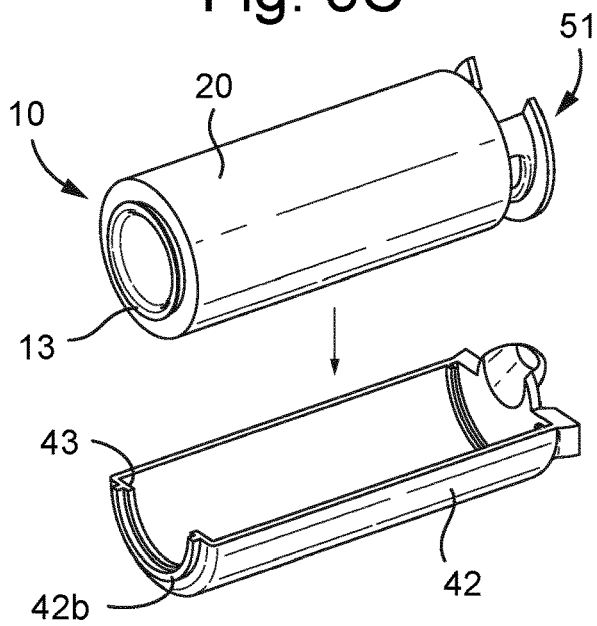

The first component of the insulation support assembly 40 is the base heating chamber support 51 which is sleeved over the base end 14 of the heating chamber 10 and over the thin film heater 12. The first heating chamber support 51 comprises an annular body 53 which extends at least partially around the circumference of the base end 14 of the heating chamber 10 and further comprises a number of axial struts 52 which extend partially along the length of the heating chamber 10 from the annular body 53. In this way, the struts 52 engage with the end 14 of the heating chamber 10 and provide the support which allows it to be mounted securely within the surround 40. As shown in FIG. 3B the struts 52 extend over the thin film heater 12 to securely grip the thin film heater 12 and the heating chamber 10. The layer of insulation 20, in the form of a sheet of thermally insulating material is then wrapped circumferentially around the heating chamber, thin film heater 12 and struts 52 of the first heating chamber support 51 as shown in FIG. 3C. The assembled heating chamber 10 and insulating layer 20 are then positioned in the first semi-cylindrical portion 42 of the rigid surround 40, as shown in FIG. 3C.

Figure 3D:
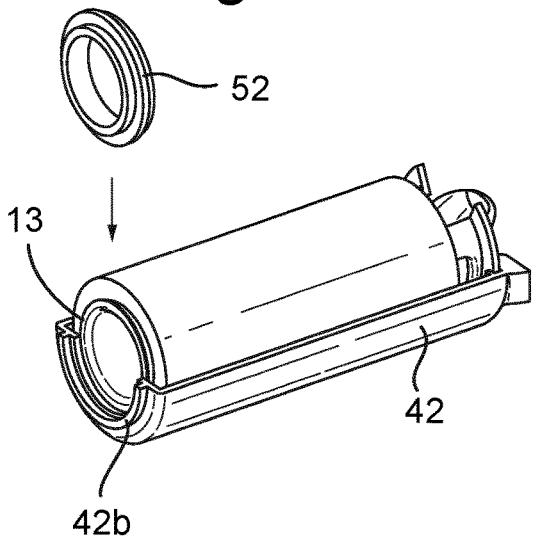
Figure 3E:
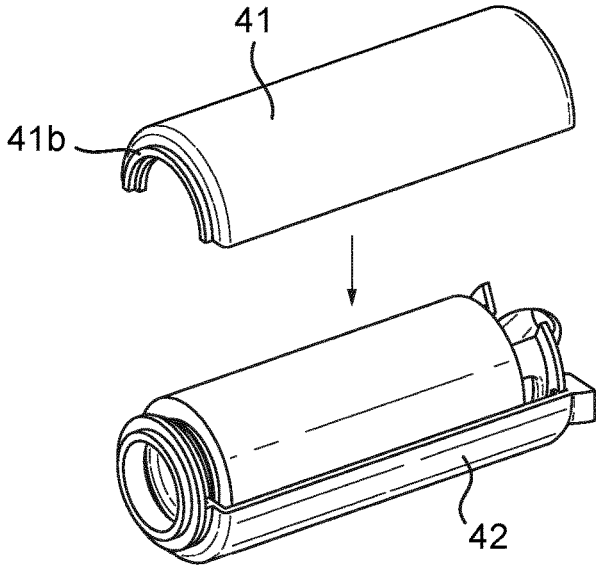

In this example, a circumferential flange or lip 15 around the open end 13 of the heating chamber is received in a corresponding circumferential recess 43 running around an inner surface of the open end 42*b* of the first portion 42 of the rigid surround 40. As shown in FIG. 3D the second heating chamber support 52 is then connected to the open end 42*b* of the heating chamber and engages with the lip 15 and a connection point around the open end of the semi-cylindrical portions 41, 42 of the rigid surround 40. The lip 15 of the heating chamber is held within a recess formed by the open ends 41*b*, 42*b* of the tubular casing and heating chamber support 52.

This mechanical connection of the heating chamber support 52, tubular casing 41, 42 and the lip 15 of the heating chamber 10 is shown in the enlarged detail of FIG. 1B. In particular, it is shown that heating chamber support 52 is clipped into a connection point at the open end of the tubular casing parts 41, 42 in such a way as to grip the lip 15 of the heating chamber 10 between the ends 41*b*, 42*b* of the semi-cylindrical portions 41, 42 of the casing 40 and the heating chamber support 52. In this way, there is only a direct contact with the heating chamber 10 at the open end at the cylindrical rim 15, reducing heat transfer to the heater support 52.

Figure 3F:
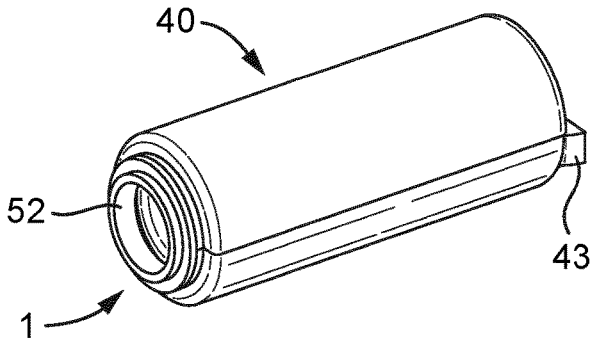

Returning to FIG. 3E, the second portion 41 of the cylindrical housing 40 is then clipped into position to form the complete housing around the insulation and tubular heating chamber 10 to provide the heater assembly 1 as shown in FIG. 3F. Mechanical connection portions 43 at the base of the casing 40, together with the second heating chamber support 52 allow for connection of the assembled heater assembly 1 into the aerosol generating device 100.

A further example of a heater assembly 1 according to the present invention is illustrated in FIGS. 4A to 4E. This arrangement utilises the same core inventive concept in the use of an insulation support assembly 30 including a rigid surround 40 which acts to hold the insulation layer 20 in position around the heating chamber 10. However, in this example of the invention, rather than the rigid surround 40 being positioned outside of the insulation layer 20 so as to hold the insulation layer 20 at its outer surface, the rigid surround 40 comprises a frame 40 which supports the insulation layer 20 from below, against its (radially) inner surface. In particular, the frame 40 provides a supporting surface around which the insulation surface 20 is wrapped.

Figure 4A:
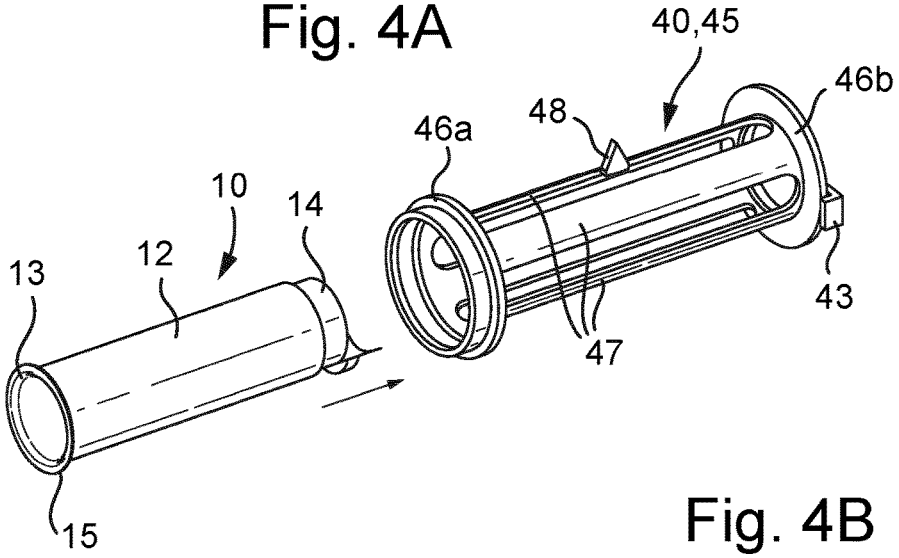
FIGS. 4A to 4E are schematic views of a heater arrangement for an aerosol generating device.
Figure 4B:
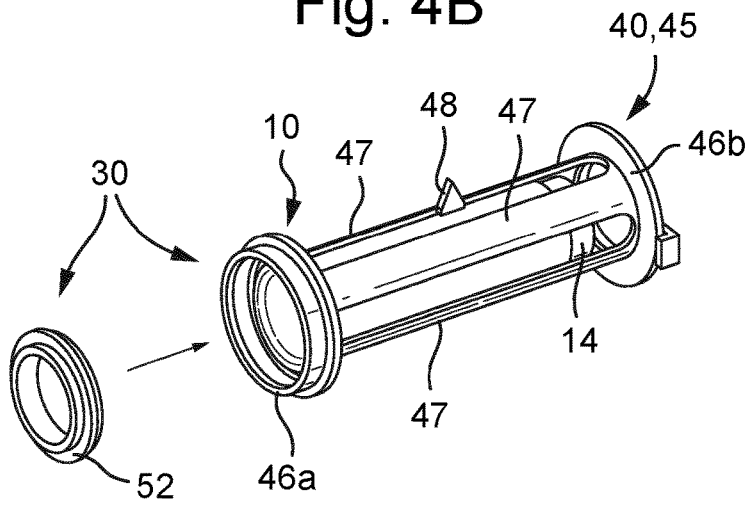
Figure 4C:
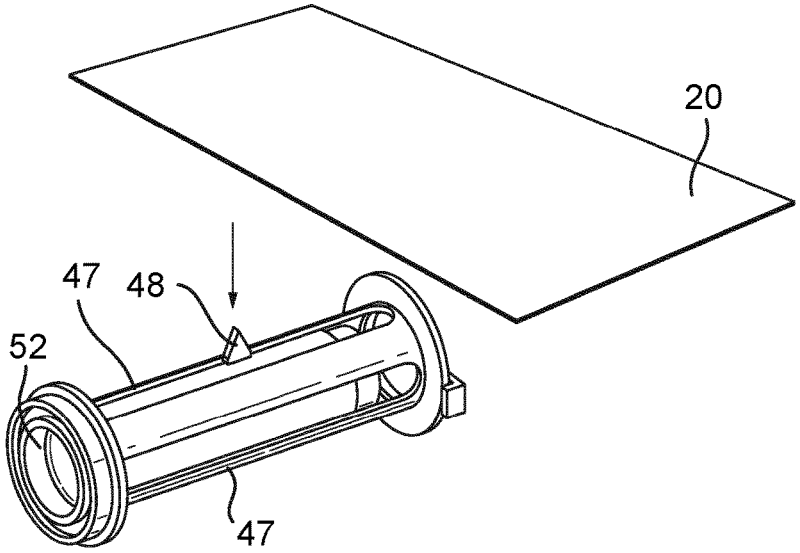

As with the example of FIGS. 1 and 3 in this example the heating chamber 10 is heated by a thin film heater 12 which is wrapped circumferentially around an outer surface of the heating chamber 10, as shown in FIG. 4A. As described above, in this case the rigid surround 40 is in the form of a tubular frame 45 which is sleeved around the tubular heating chamber 10. The frame 45 providing the rigid surround 40 comprises two end rings 46 and a plurality of longitudinal struts which extend between the end rings 46 in a direction corresponding to the elongate axis of the tubular heating chamber 10. As shown in FIG. 4B, the tubular heating chamber 10 is inserted into the frame 45 such that the heating chamber 10 is surrounded by the frame 45 and the longitudinal struts 47 extend along the length of the heating chamber 10.

As with the example of FIGS. 1 and 3, the end ring 46*a* at the open end of the chamber may be configured to engage with a circumferential lip 15 running around the open end 13 of the heating chamber 10. In some examples a similar connection mechanism may be used as that shown in the enlarged detail of FIG. 1B in which the end ring 46*a* of the frame 45 and the heating chamber support 52 mechanically engage around the lip 15 of the heating chamber to secure it in position. In this example, the base end ring 46*b*, shown in FIG. 4B, of the support frame 45 takes the place of the first heating chamber support 51 in the examples of FIGS. 1 and 3. In particular, the frame 45 extends beyond the base end 14 of the heating chamber 10 and it may be used in a similar way to connect the frame 45 within the aerosol generating device 100, using a connection feature 43.

Figure 4D:
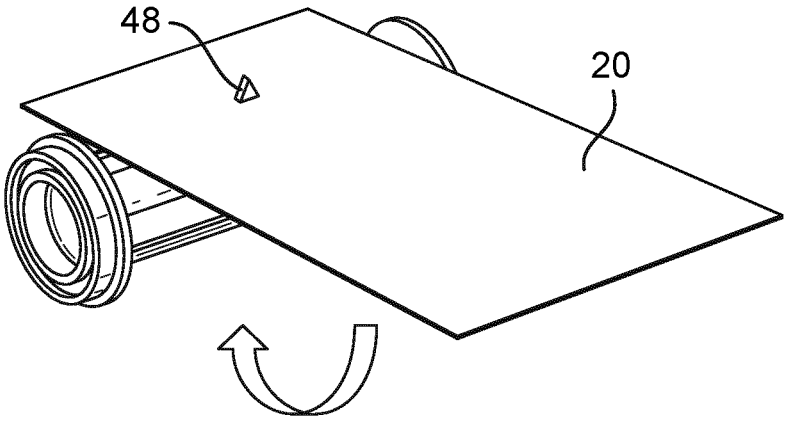

With the tubular heating chamber 10 and thin film heater 12 held by the mechanical connection of the frame 45 and heating chamber support 52, and the contact of the longitudinal struts 47 on the outer surface of the thin film heater 12, the sheet of insulating material 20 is then wrapped around the outer surface of the frame 45 formed by the longitudinal struts 47 the frame 45. The frame 45 may further include one or more gripping means 48, in this case in the form of a barb 48 which pierces and grips the sheet of thermally insulating material 20 as shown in FIG. 4D. The sheet of thermally insulating material 20 is then wrapped circumferentially around the frame 45 and secured with the engagement with the barb 48. As in all examples other attachment means may be used instead or in addition, such as pieces of adhesive tape to hold the insulation layer 20 in position.

Figure 4E:
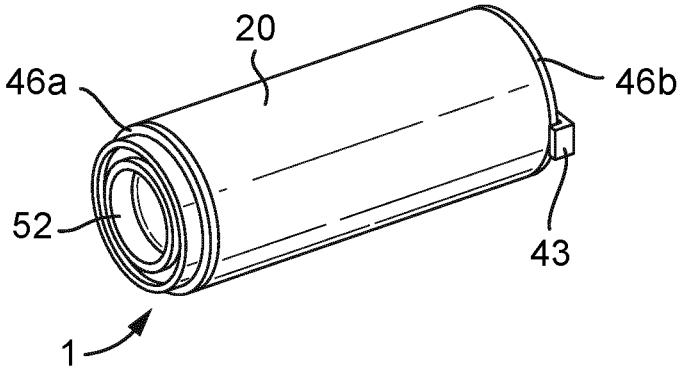

As with the previously described examples, the heater arrangement 1, shown in FIG. 4E, comprises a sheet of thermally insulating material 20 held by an insulation support assembly which engages with the heating chamber 10 and holds the insulation layer 20 in position around the heating chamber 10. The assembled heater assembly 1 may then be connected into an aerosol generating device 100, such as that pictured in FIGS. 2A and 2B. In particular, the end rings 46 of the frame 45 may comprise mechanical attachment means such as a clip 43, in this example on the base end ring 46*b*, allowing a mechanical connection with a heating chamber frame 110 within the aerosol generating device 100. The heater chamber support 52 may also allow for connection with the internal components of the device, as shown in FIG. 2B in which it connects with an end cap 120 which acts to hold the heater assembly 1, together with the frame 110, securely in position within the device 100.

A further example of the heater arrangement according to the present invention is illustrated in FIGS. 5A to 5E. The arrangement of FIG. 5 uses a tubular housing 40 as the rigid surround in a similar manner to the examples of FIG. 1 and FIG. 3 but uses an alternate means of attaching the sheet of thermally insulating material 20 and an alternate means of engaging the tubular housing 40 with the heating chamber 10.

Figure 5A:
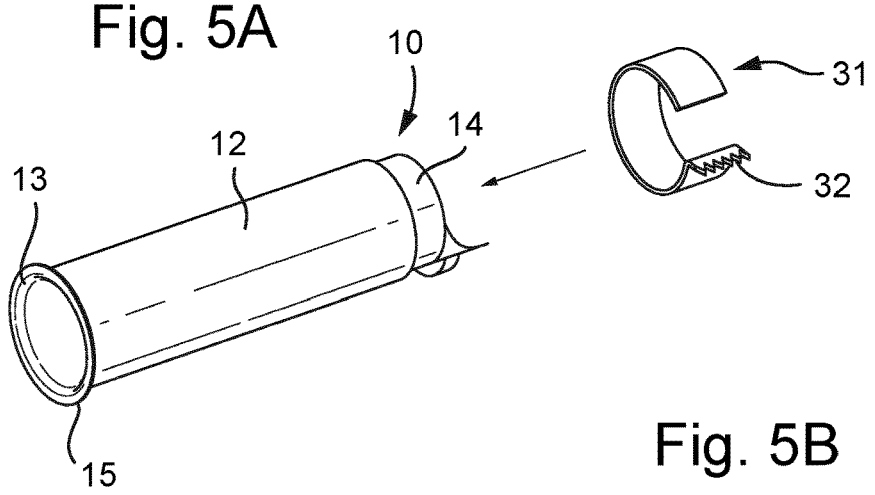
FIGS. 5A to 5E are schematic views of a heater arrangement for an aerosol generating device.
Figure 5B:
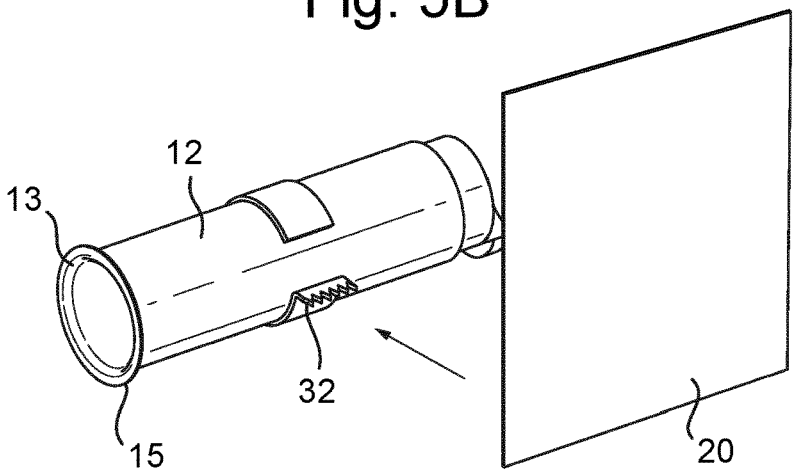

As with each of the previous examples, a heater 12 is wrapped around the outer surface of the heating chamber 10 as shown in FIG. 5A. The example of FIG. 5 includes an additional component in the form of a clamp 31 which is sleeved around the thin film heater and includes gripping means 32 in the form of a barbed surface 32 which extends radially outward from the heating chamber 10 and acts in a similar way to the barb 4 of the arrangement of FIG. 4 in order to secure the sheet 20 of heating material. The clamp 31 may be replaced with alternate means for gripping the sheet of thermally insulating material 20, for example an adhesive, or other types of gripping member. In this example, the clamp 31 is in the form of a C-shaped component which is sleeved on the heating chamber 10 and thin film heater 12 with a serrated outward facing edge 32 arranged to engage and grip the sheet of thermally insulating material 20, as shown in FIG. 5B. The sheet of insulating material 20 is wrapped onto the gripping means 31 so as to circumferentially wrap around the heating chamber 10 and thin film heater 12 one or more times as shown in FIG. 5C.

Figure 5C:
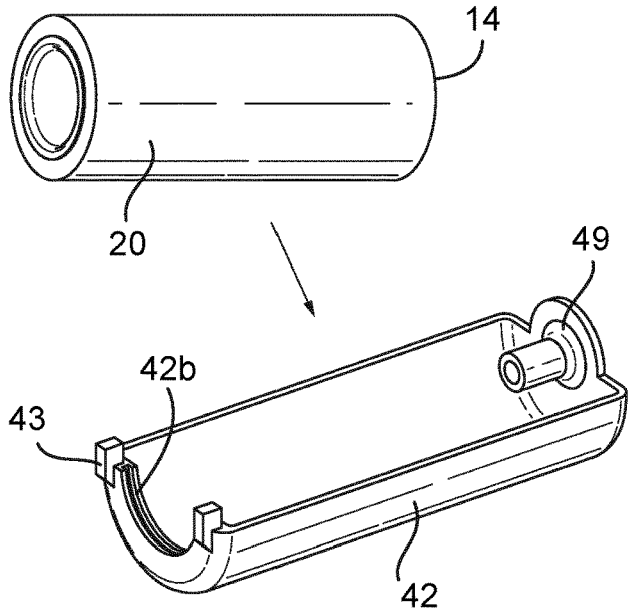
Figure 5D:
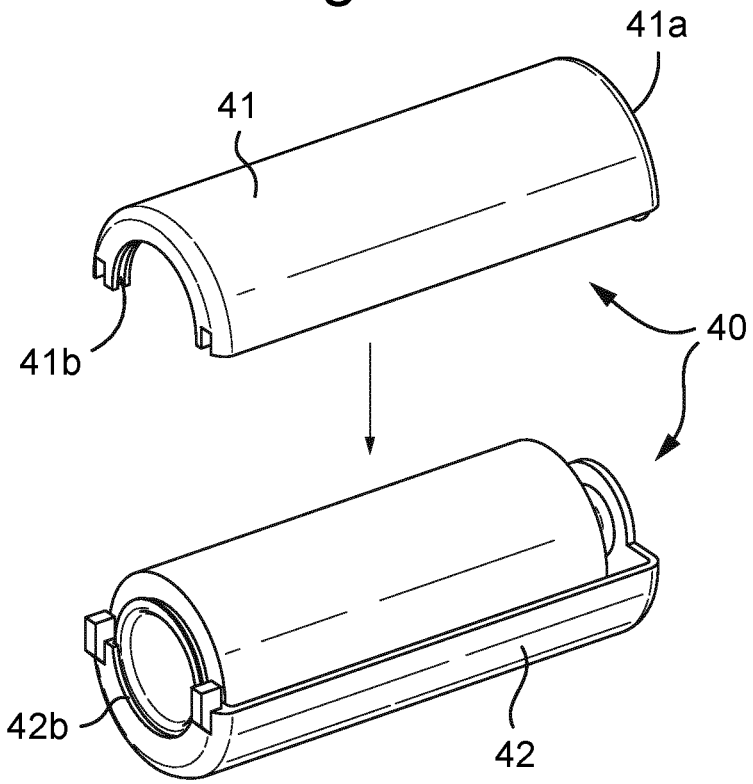
Figure 5E:
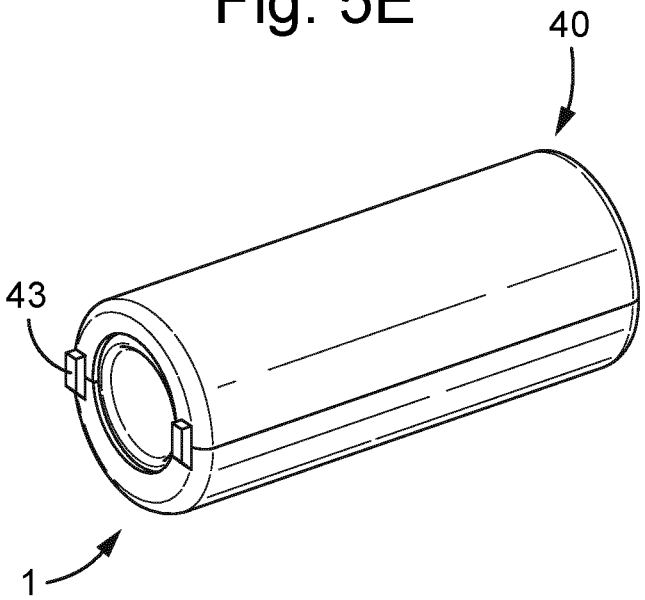

As shown in FIGS. 5C to 5E, the rigid surround 40 is in the form of a tubular casing or housing 40 comprising two semi-cylindrical housing parts 41 and 42 which connect along a longitudinal interface to form a complete cylindrical housing around the insulated heating chamber 10. As with all similar examples of the invention utilising a multipart housing, the parts 41, 42 may clip together mechanically or with an adhesive or other fixation means. The tubular casing providing the rigid surround 40 of the example of FIG. 5 differs from the examples of FIG. 1 and FIG. 3 in the way in which it engages with the tubular heating chamber 10. In this example, the tubular casing 40 comprises an internal protrusion 49 extending from the base internal surface to contact the outer base surface at the closed end 14 of the heating chamber 10.

The protrusion 49 is configured to engage heating chamber 20 to provide a stabilising contact to hold the heating chamber 10 in position within the tubular housing 40. In some examples the tubular heating chamber 10 may have a corresponding recess provided on the outer base surface at the closed end 14 with which the protrusion 49 engages to provide extra stabilisation of the heating chamber 10. The protrusion 49 may be provided on one of the two semi-cylindrical portions 41, 42. In the case of FIG. 5 it is provided on the lower semi-cylindrical portion 42 as shown in FIG. 5C. The other semi-cylindrical portion 42 of the tubular housing 40 may have an opening at the base end 41*a* to allow the connections of the heater to pass through. In particular, portion 41 shown in FIG. 5D may be completely open at the base end 41*a* to leave a opening through which the heater connections can pass.

The open end of the tubular casing 41*b*, 42*b* may comprise a circumferential recess 43 provided around an inner surface of the opening which is configured to engage with a circumferential lip 15 provided around the first, open, end 13 of the heating chamber 10. In other examples, the tubular casing 40 may engage in different ways with the heating chamber 10, for example having a number of radially inwardly extending protrusions which contact the outer surface of the chamber or having a collar portion which engages with the chamber which does not necessitate the need for a circumferential ridge 15 around the open end 13 of the heating chamber 10.

The heating chamber 10 wrapped with the insulating sheet 20 is positioned within a first semi-cylindrical portion 42 of the housing 40 as shown in FIG. 5C. The protrusion 49 engages with the base of the heating chamber 10 and the open end 13 of the heating chamber engages with the opposing surfaces of the open ends 41B, 42B of the housing 40, securing the heating chamber 10 in position within the housing 41, 42 without requiring additional heater supports present in the examples of FIG. 3 and FIG. 4. The assembled heater arrangement 1 shown in FIG. 5E may have one or more mechanical features 43 provided on the outer surface and/or ends of the tubular housing 40 to facilitate connection of the heater arrangement 1 within the aerosol generating device 100, as explained above. This arrangement reduces the number of components of the insulation support assembly required and provides good thermal insulation, given there is no contact with the cylindrical outer surface of the heating chamber.

A further example of a heater arrangement 1 according to the present invention is shown in FIGS. 6A to 6E. This example differs from those described above in that it includes a welded support cap 33 which is welded onto the base end 14 of the heating chamber 10 and uses a means to support a tubular casing 40.

Figure 6A:
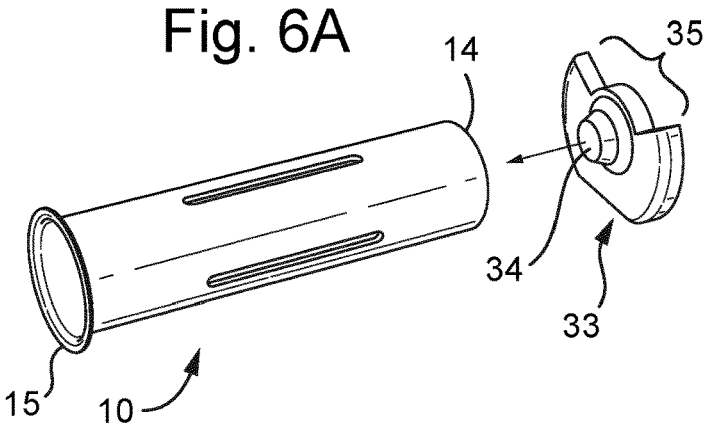
FIGS. 6A to 6E are schematic views of a heater arrangement for an aerosol generating device.

As shown in FIG. 6A the support cap 33 is a substantially planar component having a substantially circular disc shape with an open portion 35 such that it resembles a circular disc with a radial segment removed to form an opening 35. The support cap 33 additionally comprises a protrusion 34 which extends perpendicularly away from the flat plane of the disc shaped body. The protrusion 34 is configured to engage with the base surface at the closed end 14 of the heating chamber 10. As shown in FIG. 6C the protrusion may be spot welded at a number of weld points 36 to the base surface of the closed end 14 of the heating chamber 10. In this example, the base end 14 of the heating chamber 10 includes a recess 18 configured to receive the protrusion 34 of the support cap 33.

Spot welding in this way provides a thermal barrier between the heating chamber 10 and the support cap 33 significantly limiting thermal transfer between the heat cap 10 and the support cap 33. Furthermore, since the support cap 33 is welded to the coldest point on the heating chamber 10, thermal transfer from the heating chamber to the insulation support to the surrounding components is further reduced. Once connected to the heating chamber 10, the support cap 33 provides means to connect the surrounding housing and mount the heater arrangement 1 within an aerosol generating device 100. Additional portions of insulating material 37 may be provided between the base of the heating chamber 10 and the support cap 33 to further reduce thermal transfer to the support cap 33, as shown in FIG. 6C.

Figure 6B:
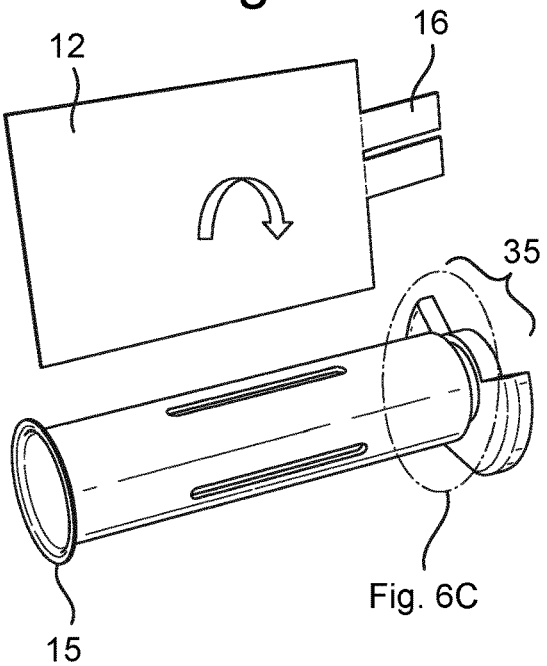
Figure 6C:
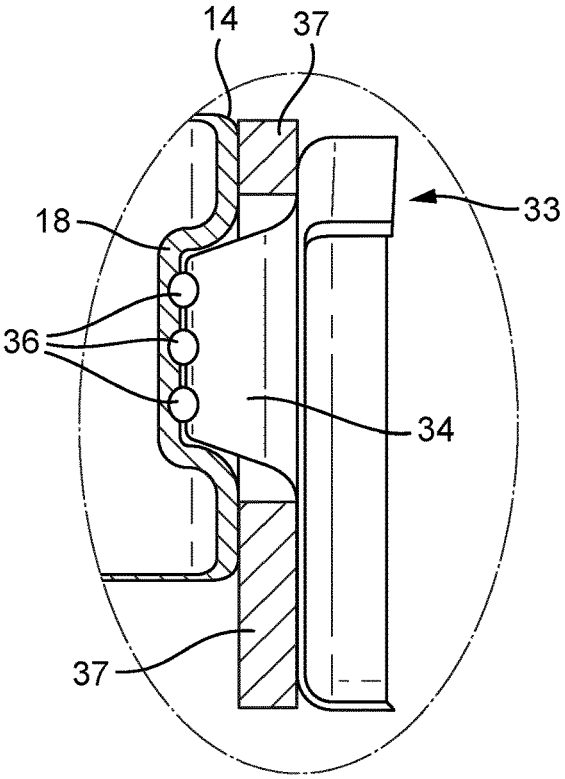

As with previous examples of the invention, a heater 12 is wrapped circumferentially around the outer surface of the tubular heating chamber 10 as shown in FIG. 6B. With the support cap 33 already connected to the heating chamber 10, the electrical connection 16 for the heater 12 may be aligned so that they pass through the gap 35 provided in the support cap 33 as shown in FIG. 6B.

Figure 6D:
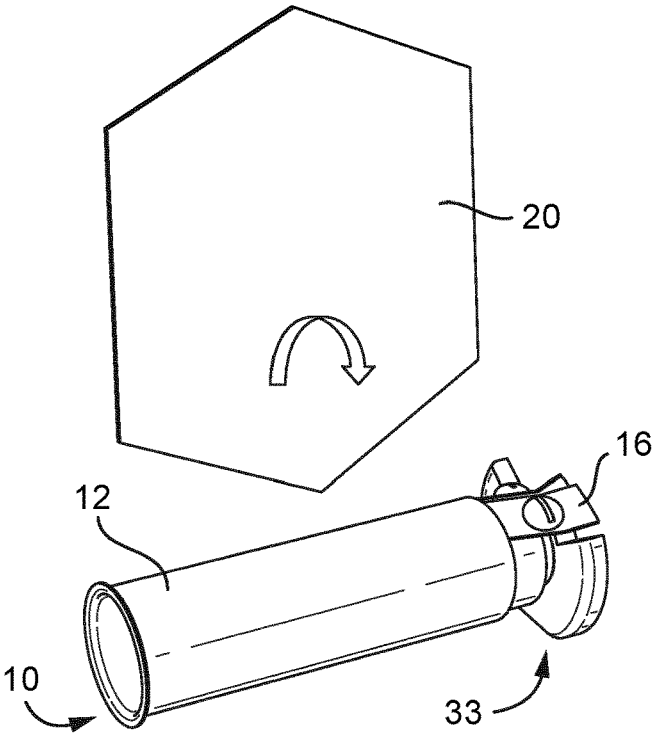
Figure 6E:
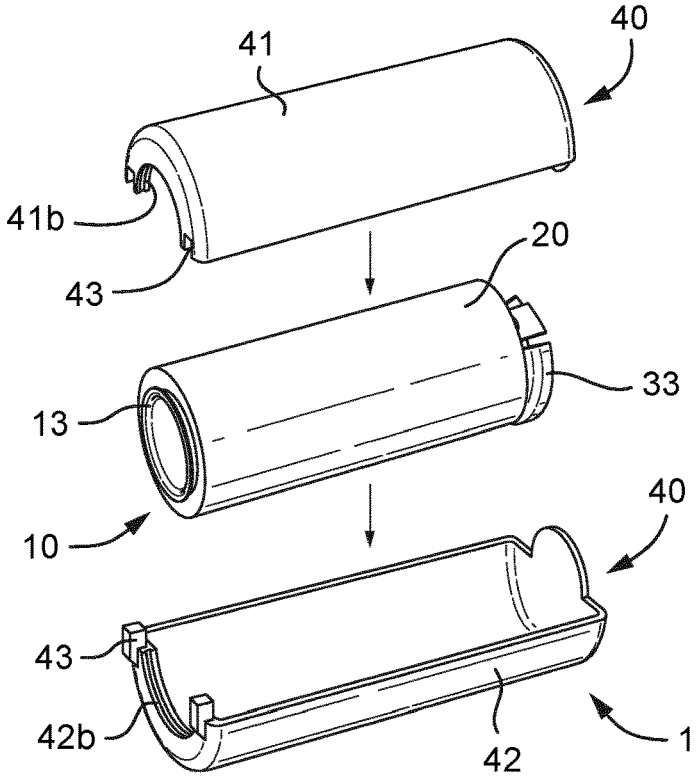

Once the thin film heater 12 is wrapped around the outer surface of the heating chamber as shown in FIG. 6D, the sheet of insulation 20 is then wrapped around the outer surface of the thin film heater 12. As with the examples of FIGS. 1, 3 and 5 the rigid surround 40 is provided by a two part tubular housing 41, 42 which is then connected around the insulated heating chamber 10 to form a tubular casing 40 which acts to hold the sheet of insulation 20 in position around the heating chamber 10. Again, the semi-cylindrical housing portions 41, 42 may mechanically connect along the longitudinal interface or may be secured by other means, for example with an adhesive.

As described above, the open end of the tubular casing 41*b*, 42*b* may engage with the open end of the heating chamber 13 in order to provide further stabilisation and support of the heating chamber within the rigid surround 40. This may be achieved via a provision of a circumferential lip or flange 15 as shown most clearly in FIGS. 6A and 6B which is received within a corresponding circumferential recess 43 provided around the opening of the casing 40. The tubular casing 41, 42 may additionally comprise one or more mechanical features to allow for the heater arrangement to be mounted within an aerosol generating device 100.

A number of additional features and modifications may be applied to the above examples within the scope of the present invention. The thermal insulation may be in the form of a sheet which is wrapped once or multiple times about the heating chamber. Where the rigid surround is in the form of a casing it may be dimensioned to engage the outer surface of the wrapped thermal insulation. In each case the layer of thermal insulation 20 may be additionally supported by a piece of adhesive tape provide extra support. Further thermal insulation may be provided within the tubular casing 41, 42 at the base surface near the closed end of the heater to further insulate the tubular heating chamber 10.

The insulation support assembly 30 may be assembled by mechanical connection and/or guiding elements such as pin/holes, press fitting, ultrasonic welding, inorganic adhesive, screws or magnets for example. To further secure the rigid surround 40 in place, the rigid surround 40 can be externally covered by an adhesive supporting layer such as a graphite layer with an adhesive layer. The rigid surround may also be internally coated with a metal heat reflective layer or metal foil which could in some examples be wound together with a super insulation layer to further enhance the heat management properties of the device.

The present invention therefore provides a low cost, light weight and easy to assemble means to insulate a heating chamber within an aerosol generating device.

Definitions and Alternative Embodiments

It will be appreciated from the description above that many features of the described embodiment perform independent functions with independent benefits. Therefore the inclusion or omission of each of these independent features from embodiments of the invention defined in the claims can be independently chosen.

The term "heater" should be understood to mean any device for outputting thermal energy sufficient to form an aerosol from the aerosol substrate. The transfer of heat energy from the heater to the aerosol substrate may be conductive, convective, radiative or any combination of these means. As non-limiting examples, conductive heaters may directly contact and press the aerosol substrate, or they may contact a separate component such as the heating chamber which itself causes heating of the aerosol substrate by conduction, convection, and/or radiation.

Heaters may be electrically powered, powered by combustion, or by any other suitable means. Electrically powered heaters may include resistive track elements (optionally including insulating packaging), induction heating systems (e.g. including an electromagnet and high frequency oscillator), etc. The heater may be arranged around the outside of the aerosol substrate, it may penetrate part way or fully into the aerosol substrate, or any combination of these. For example, instead of the heater of the above-described embodiment, an aerosol generation device may have a blade-type heater that extends into an aerosol substrate in the heating chamber.

Aerosol substrate includes tobacco, for example in dried or cured form, in some cases with additional ingredients for flavouring or producing a smoother or otherwise more pleasurable experience. In some examples, the aerosol substrate such as tobacco may be treated with a vaporising agent. The vaporising agent may improve the generation of vapour from the aerosol substrate. The vaporising agent may include, for example, a polyol such as glycerol, or a glycol such as propylene glycol. In some cases, the aerosol substrate may contain no tobacco, or even no nicotine, but instead may contain naturally or artificially derived ingredients for flavouring, volatilisation, improving smoothness, and/or providing other pleasurable effects. The aerosol substrate may be provided as a solid or paste type material in shredded, pelletised, powdered, granulated, strip or sheet form, optionally a combination of these. Equally, the aerosol substrate may be a liquid or gel. Indeed, some examples may include both solid and liquid/gel parts.

Consequently, the aerosol generating device 1 could equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The aerosol generation device may be arranged to receive the aerosol substrate in a pre-packaged substrate carrier. The substrate carrier may broadly resemble a cigarette, having a tubular region with an aerosol substrate arranged in a suitable manner. Filters, vapour collection regions, cooling regions, and other structure may also be included in some designs. An outer layer of paper or other flexible planar material such as foil may also be provided, for example to hold the aerosol substrate in place, to further the resemblance of a cigarette, etc. The substrate carrier may fit within the heating chamber or may be longer than the heating chamber such that the lid remains open while the aerosol generation device 1 is provided with the substrate carrier. In such embodiments, the aerosol may be provided directly from the substrate carrier which acts as a mouthpiece for the aerosol generation device.

As used herein, the term "aerosol" shall mean a system of particles dispersed in the air or in a gas, such as mist, fog, or smoke. Accordingly the term "aerosolise" means to make into an aerosol and/or to disperse as an aerosol. Note that the meaning of aerosol/aerosolise is consistent with each of volatilise, atomise and vaporise. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. A heater arrangement for an aerosol generating device, the heater arrangement comprising:

a tubular heating chamber comprising a cavity arranged to receive an aerosol generating substrate;

a layer of insulation wrapped so as to circumferentially surround the heating chamber;

an insulation support assembly comprising a rigid surround arranged circumferentially around the heating chamber; wherein the insulation support assembly is arranged to engage the heating chamber and the layer of insulation to hold the layer of insulation in position around the heating chamber, and the layer of insulation is wrapped around an outer surface of the rigid surround.

2. The heater arrangement of claim 1, wherein the insulation support assembly is arranged to contact the heating chamber only at one or both ends of the heating chamber to support the rigid surround in position around the heating chamber.

3. The heater arrangement of claim 2, wherein the insulation support assembly comprises one or more annular supports, wherein the one or more annular supports are mounted around an end of the heating chamber and support the rigid surround in position around the heating chamber.

4. The heater arrangement of claim 1, wherein the rigid surround comprises a frame comprising a plurality of longitudinal struts running along a length of the tubular heating chamber; wherein the layer of insulation is wrapped around an outer surface formed by the longitudinal struts.

5. The heater arrangement of claim 1, wherein the rigid surround comprises a gripping member extending radially outward from the rigid surround, wherein the gripping member is arranged to grip the layer of insulation and hold at least a portion of the layer of insulation in position.

6. The heater arrangement of claim 1, wherein the rigid surround comprises a tubular casing arranged to enclose the tubular heating chamber to form a cylindrical cavity between an outer surface of the heating chamber and an inner surface of the casing, wherein the layer of insulation is held within the cavity.

7. The heater arrangement of claim 6, wherein the cylindrical cavity has a radial thickness between 2 mm and 4 mm.

8. The heater arrangement of claim 6, further comprising an annular support positioned at one end of the tubular heating chamber between the tubular heating chamber and the casing, the annular support extending around a majority of a circumference of the tubular heating chamber.

9. The heater arrangement of claim 8, wherein the annular support comprises a plurality of axial struts extending along an axis of the tubular heating chamber and arranged to hold the heating chamber within the casing.

10. The heater arrangement of claim 1, further comprising a circumferential lip, wherein the insulation support assembly comprises a connection feature arranged to receive the circumferential lip to hold the heating chamber in position.

11. The heater arrangement of claim 6, wherein the tubular casing comprises two semi-cylindrical parts configured to connect along a longitudinal interface to form the tubular casing around the heating chamber.

12. The heater arrangement of claim 6, further comprising a gripping member attached to the outer surface of the heating chamber arranged to grip the layer of insulation and hold at least a portion of the layer of insulation in position.

13. The heater arrangement of claim 12, wherein the gripping member comprises a barbed clamp arranged to attach to the outer surface of the heating chamber below the layer of insulation, the barbed clamp comprising an outward facing barb configured to grip the layer of insulation.

14. The heater arrangement of claim 6, wherein the tubular casing comprises a base surface at least partially enclosing the tubular casing around a closed end of the tubular heating chamber; the tubular casing being arranged to provide a gap between the base surface of the casing and the closed end of the heating chamber.

15. The heater arrangement of claim 14, further comprising insulation provided within the gap between the closed end of the tubular heating chamber and the base surface of the tubular casing.

16. The heater arrangement of claim 14, wherein the base surface of the tubular casing further comprises an opening to allow electrical connections to the heating chamber to pass through.

17. The heater arrangement of claim 16, wherein the base surface is configured such that the opening is directed at an angle relative to a longitudinal axis of the heating chamber.

18. The heater arrangement of claim 6, wherein the tubular heating chamber comprises an open end arranged to receive the aerosol generating substrate and an opposing closed end; where the tubular casing comprises a closed end, the closed end comprising a protrusion extending from an inner surface to engage the closed end of the heating chamber.

19. The heater arrangement of claim 18, wherein the closed end of the tubular heating chamber comprises a recess in an outer surface thereof and the protrusion is configured to engage with the recess.

20. The heater arrangement of claim 6, wherein the tubular heating chamber comprises an open end arranged to receive the aerosol generating substrate and an opposing closed end, the heater arrangement further comprising:

an end cap support, the end cap support welded to an outer surface of the closed end of the heating chamber and arranged to support the tubular casing in position around the heating chamber.

21. The heater arrangement of claim 19, wherein the end cap support comprises a substantially disk shaped body with a protrusion extending from the body, wherein the protrusion is welded to the outer surface of the closed end of the tubular heating chamber.

22. The heater arrangement of claim 6, wherein the tubular casing is internally coated with a metal heat reflective layer or a metal foil is wound together with the layer of insulation.

23. The heater arrangement of claim 1, wherein the layer of insulation comprises ceramic fibre.

24. The heater arrangement of claim 23, wherein the layer of insulation comprises one or more metal oxides.

25. The heater arrangement of claim 23, wherein the layer of insulation comprises aluminium oxide, silicon oxide and/or $ZrO_2$.

26. The heater arrangement of claim 1, wherein the layer of insulation comprises an aerogel.

27. The heater arrangement of claim 1, wherein the layer of insulation is a blanket, felt or paper.

28. The heater arrangement of claim 1, wherein the insulation support assembly comprises a non-metal material.

29. The heater arrangement of claim 28, wherein the non-metal material is a heat resistant polymer.

30. A heater arrangement for an aerosol generating device, the heater arrangement comprising:

a tubular heating chamber comprising a cavity arranged to receive an aerosol generating substrate;

a layer of insulation wrapped so as to circumferentially surround the heating chamber;

an insulation support assembly comprising a rigid surround arranged around the heating chamber; wherein the insulation support assembly is arranged to engage the heating chamber and the layer of insulation to hold the layer of insulation in position around the heating chamber, the layer of insulation is wrapped around an outer surface of the rigid surround, and the rigid surround comprises a frame comprising a plurality of longitudinal struts running along an entire length of the tubular heating chamber; wherein the layer of insulation is wrapped around an outer surface formed by the longitudinal struts.

* * * * *